US006807699B2

(12) United States Patent
Michelman

(10) Patent No.: US 6,807,699 B2
(45) Date of Patent: Oct. 26, 2004

(54) COMBINATION SCREWDRIVER AND HEAVY DUTY STAPLE REMOVER METHOD

(76) Inventor: Harold Michelman, 457 Long Beach Blvd., Long Beach, NY (US) 11561

( * ) Notice: Subject to any disclaimer, the term of this patent is extended or adjusted under 35 U.S.C. 154(b) by 0 days.

(21) Appl. No.: 10/328,638

(22) Filed: Dec. 26, 2002

(65) Prior Publication Data

US 2004/0123397 A1 Jul. 1, 2004

(51) Int. Cl.[7] ..... B25C 11/00; B25B 15/00
(52) U.S. Cl. ..... 7/165; 254/28; 227/63
(58) Field of Search ..... 7/165, 160, 108; 81/436, 461; 254/28; 227/63

(56) References Cited

U.S. PATENT DOCUMENTS 101,207 A * 3/1870 Apgar ..... 81/436
1,411,242 A * 3/1922 Faust ..... 81/436
4,049,236 A * 9/1977 Grill et al. ..... 254/28
5,870,811 A * 2/1999 Ciok ..... 254/28
5,918,337 A * 7/1999 Evling et al. ..... 7/108
6,663,082 B1 * 12/2003 Ploeger ..... 254/21

* cited by examiner

*Primary Examiner*—Hadi Shakeri
(74) *Attorney, Agent, or Firm*—Myron Amer PC

(57) ABSTRACT

The function of a clenched heavy duty staple removal from closure flaps of a cardboard container is added by a structural modification of a hooking configuration machined in the distal end of a screwdriver and a modification in the mode of use thereof in which a clenched staple end is engaged by being hooked and remains thusly engaged during an applied pulling force which unclenches the opposite staple end so that the staple ends simultaneously completely disengage to obviate only partial disengagement as now frequently occurs.

1 Claim, 3 Drawing Sheets

FIG. 8
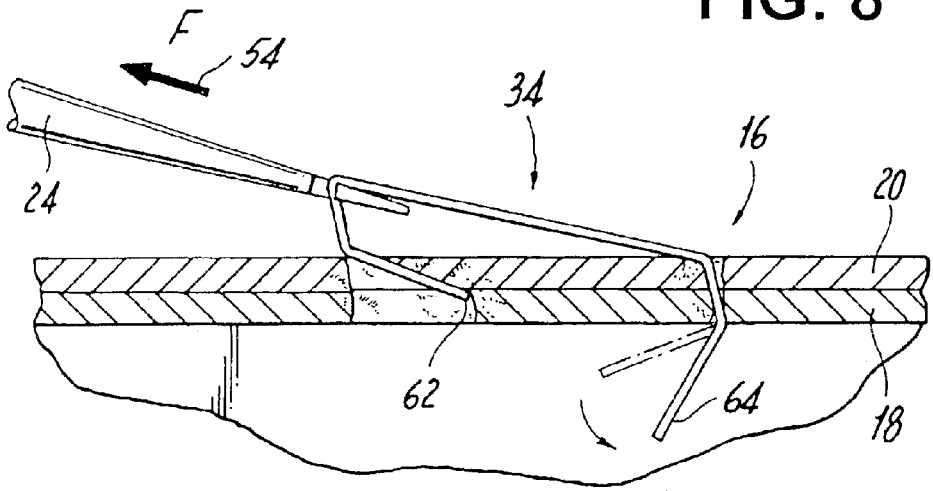
FIG. 9
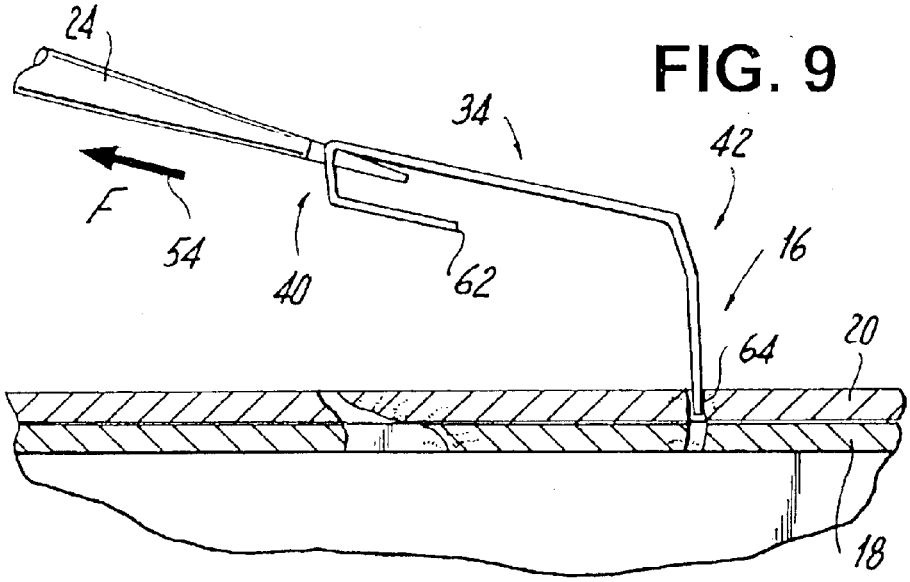
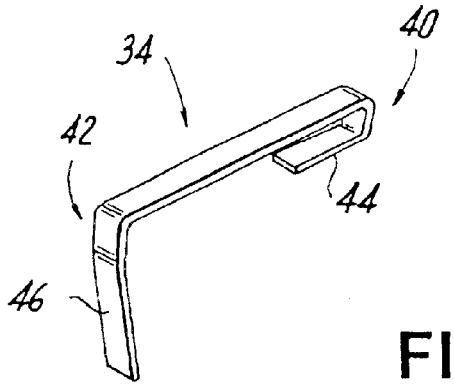
FIG. 10

COMBINATION SCREWDRIVER AND HEAVY DUTY STAPLE REMOVER METHOD

The present invention relates to improvements in the use of hand tools as applied, more particularly, to a combination screwdriver and heavy duty staple remover.

EXAMPLES OF THE PRIOR ART

It is common in the packaging of articles of manufacture for transit to use a stapling apparatus to apply heavy duty staples in a clenched condition in overlapping closure flaps of a cardboard shipping carton, a practice well documented in the prior patented literature, as exemplified by U.S. Pat. No. 4,205,823 for "STAPLE REMOVER" issued to Goldy on Jun. 3, 1980. While serving the needs of preventing product damage during transit at the receiving site, which often is where the product is to be offered for sale or to be put into an industrial use, removing the staples from their clenched engagement to the closure flaps currently occasions difficulty because of the lack of a hand tool effective by its design to accomplish the removal chore, or a better understanding of how to use an available more appropriately designed hand tool properly to unclench the heavy duty staple from its shipping carton attachment site. The use of prior art hand tools contemplate projecting a camming wedge configuration beneath the exposed middle staple leg and by the resulting ascending movement causing an unclenching opening movement of the opposite end staple legs and thus the release of the staple. Exemplifying this practice of attempting to wedge the staple free of its attachment are U.S. Pat. No. 1,802,687 for "STAPLE PULLER" issued to Vrana on Apr. 28, 1931, U.S. Pat. No. 3,583,673 for "STAPLE LIFTER" issued to Poskin on Jun. 8, 1971, and U.S. Pat. No. 3,825,226 for "STAPLE REMOVER" issued to Appleman on Jul. 23, 1974, to mention but a few. In the actual implementation of this practice, it often happens that the opposite staple ends do no release simultaneously, and so one opposite staple end remains attached to the carton often causing injury if attempted to be manually pulled free by being twisted back and forth. Such removal requires the use of pliers.

Broadly, it is an object of the present invention to overcome the foregoing and other shortcomings of the prier art.

More particularly, it is an object to use to advantage the similar dimensional size of the opposite staple end legs that have to be unclenched in a removal procedure that results in these legs being simultaneously released from the attachment site to thereby obviate any remaining still dangling injury-causing staple condition, all as will be better understood as the description proceeds.

The description of the invention which follows, together with the accompanying drawings should not be construed as limiting the invention to the example shown and described, because those skilled in the art to which this invention appertains will be able to devise other forms thereof within the ambit of the appended claims.

FIGS. 7, 8 and 9 are sectional views similar to FIG. 6, illustrating in sequence the progressive removal of the staple; and FIG. 10 is an isolated view of the removed staple.

Figure 1:
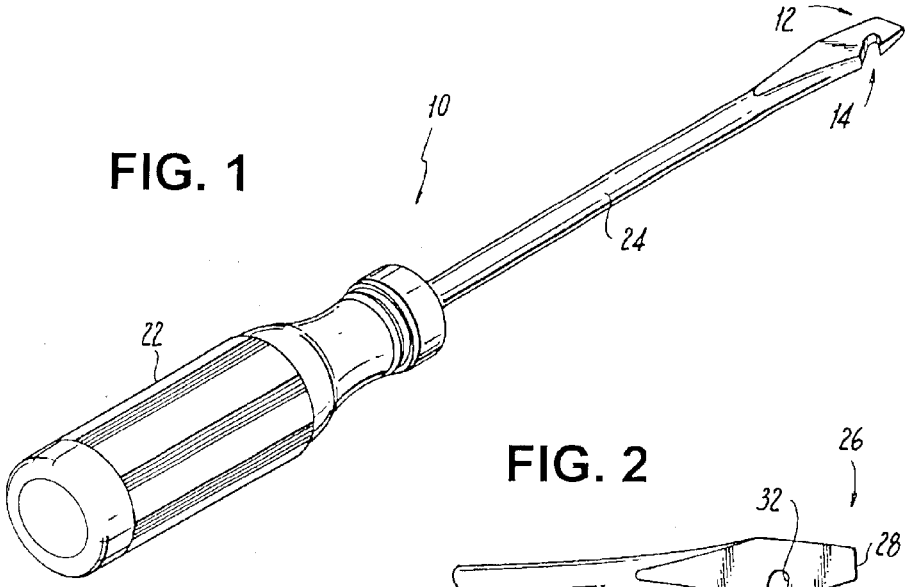
FIG. 1 is a perspective view of a hand tool combination screwdriver and heavy duty staple remover according to the present invention.
Figure 2:
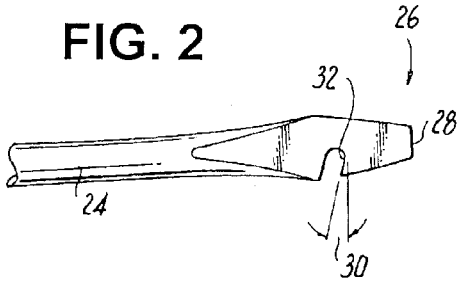
FIG. 2 is an isolated a view, in slightly enlarged scale, of the distal end of the screwdriver illustrating the machined structural details thereon having utility in heavy duty staple removal according to the present invention.
Figure 3:
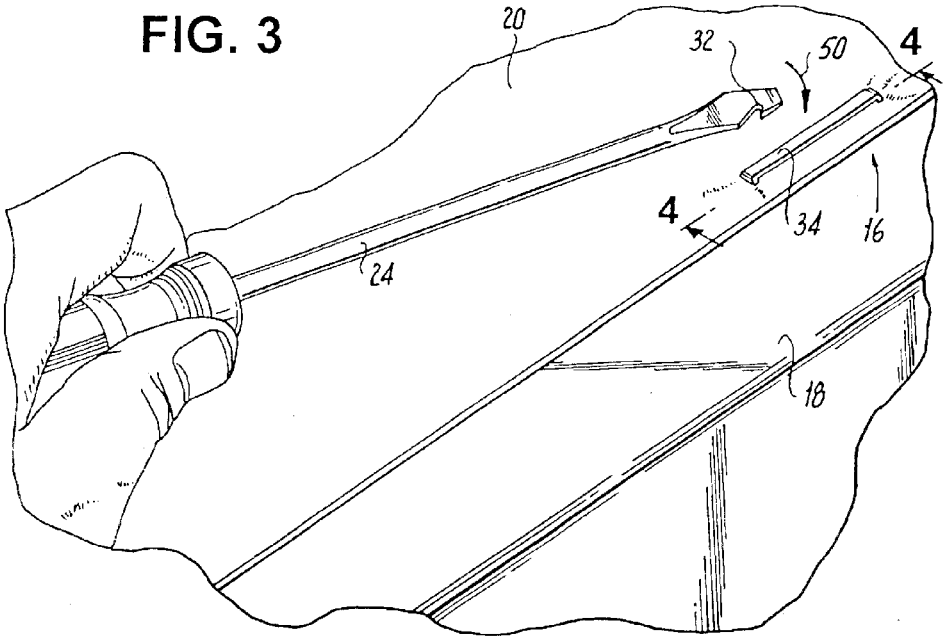
FIG. 3 is a perspective view of the positioning of the hand tool of FIG. 1 preparatory to the heavy duty staple removal.
Figure 4:
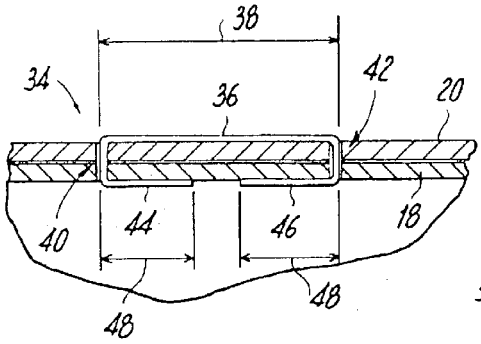
FIG. 4 is a cross-sectional view, as taken along line 4—4 of FIG. 3, illustrating details of the clenched condition of the staple requiring removal at a site of attachment.
Figure 5:
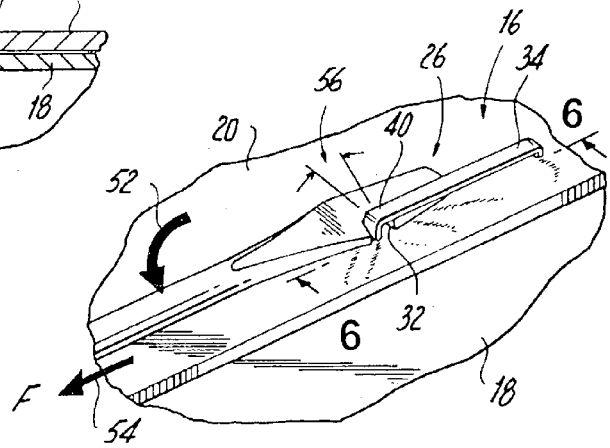
FIG. 5 is an isolated perspective view of the progression from the positioning step illustrated in FIG. 3 to a succeeding staple-engaging step.
Figure 6:
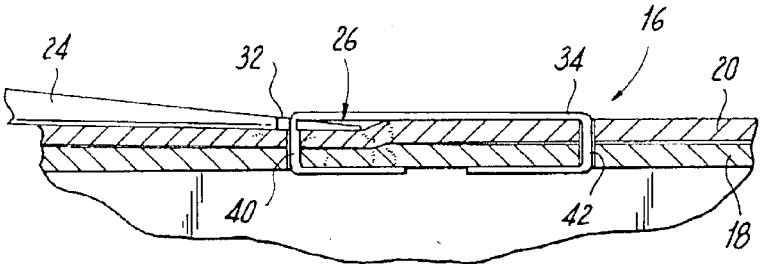
FIG. 6 is a cross-sectional view, as taken along line 6—6 of FIG. 5, illustrating details of the staple engagement.
Figure 7:
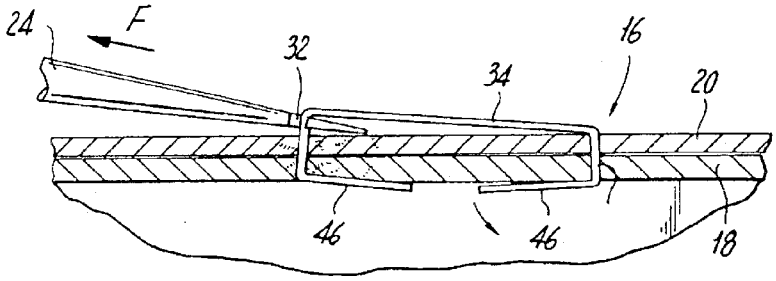

Illustrated in FIG. 1 is a hand tool, generally designated 10 which, in use optionally has the utility of a screwdriver, denoted generally at 12, and which screwdriver is modified in accordance with the present invention also to have the utility of an effective heavy duty staple remover, denoted generally at 14, the staple removed being entirely disengaged, as illustrated in FIG. 9, from a clenched condition, as illustrated in FIG. 4, from a site of attachment 16 in cardboard closure flaps 18 and 20 of a shipping container at a site of use of the container contents.

The modification according to the present invention is of the noted screwdriver 12 of the type having a hand grip 22 at a proximal end typically of plastic construction material, an elongated body 24 of appropriate metal construction material to withstand torque or twisting forces exerted during inserting or removing screws, and at a distal end 26 a wedge or triangular configuration 28 suited to engaging screws, wherein at the distal end 26 the modification according to the present invention consists of the machining, preferable at a subtended acute angle 30 to the long direction of the body 24 a hook or staple-engaging configuration 32, the use of the hook 32 for unclenching the staple 34 from the attachment site 16 being better understood from the illustrated sequence of FIGS. 3, 5, 6, 7, 8 and 9.

The clenched condition of the heavy duty staple 34 as illustrated in FIG. 4 is imparted using stapling apparatus of well known construction and operating mode, as known for example from FIG. 4 of U.S. Pat. No. 4,205,823 and which by this reference is incorporated herein pursuant to MPEP 2163.07, and consists of an exposed middle staple length portion or body 36 typically of a length 38 measuring 1½ inches between 180 degree bends 40 and 42 imparted by the stapling apparatus and strategically locating internal inwardly folded opposite staple ends 44 and 46 of similar length 48 of ⅝ inch which cooperate with the body 36 to complete the engagement of the closure flaps 18 and 20 therebetween to each other.

The unclenching of the FIG. 4 staple 34 is achieved by wedging the screwdriver distal end 26 beneath the exposed staple body 36, initially in the direction 50, after which the screwdriver is rotated, as at 52, to bring it into alignment with the long dimension of the body 36 and the opening of the hook 32 in facing relation to the staple bend 40. A pulling force F is then applied along the directional arrow 54 and at a slightly inclined subtended acute angle 56 to the plane of the top closure flap 18, which results in the seating of the staple bend 40 within the confines of the hook 32 and the thusly engaged staple 34 starting to release from the attachment site 16, during which it is important to note that a constraint imposed by the construction material of the closure flaps 18, 20 maintains the 360 degree bend 40 so that the bend 40 is manifested even in the FIG. 10 removed staple, as denoted at 58. As an important consequence, the staple 34 does not slip off or lose the established engaged relation to the screwdriver distal end 26 during movement 54 responsive to the pulling force F.

However, at the opposite end of the staple 34, and in response to the applied force F, there is no constraint imposed by construction material and at the bend 42 the staple end 46 undergoes an unclenching or unfolding pivotal traverse 60.

The force F is applied at an extent and for an appropriate duration to effectuate the removal of the staple 34 from the attachment site 16 and it has been found in practice that the physical ends 62 and 64 respectively of the opposite staple ends 44 and 46 release almost simultaneously from the attachment site 16, because the lengths as measured from the bends 40, 42 to the ends 62, 64 being of the same dimension 48 and moving at the same rate in response to the applied force F exit from the closure flaps 18, 20 are the parameters which determine when staple removal occurs. As a consequence, there does not occur any only partially disengaged heavy duty staple 34 which requires for complete disengagement the use of pliers or manually twisting or otherwise back and forth attempted freeing-movement during which injury can, and often does, occur.

For completeness sake, it is noted that heavy duty staples are readily commercially available as from Gold Crown International Staple sold under the designation "ISM" of Butler, Pa.

While the apparatus for practicing the within inventive method, as well as said method herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. A method of removing a heavy duty staple from a cardboard substrate comprising the steps of:

A. providing a screwdriver having a longitudinal axis and a staple-engaging hook configuration with a subtended acute angle of substantially 30 degrees to said longitudinal axis at a distal end thereof, B. selecting a heavy duty staple in a clenched condition at an attachment site on a cardboard substrate; wherein said heavy duty staple includes two opposite end length portions inwardly bent 180 degrees toward each other underneath said cardboard substrate and a staple central length portion, C. establishing engagement of said staple-engaging hook configuration to an end of said staple central length portion;

D. applying initially a pulling force to said engaged staple lengthwise of said staple central length portion;

E. causing in response to said initially applied pulling force (1) a partial release from said clenched condition of said engaged staple end while maintained in said 180 degree bend by said cardboard substrate, and (2) a partial directional rotational traverse from said clenched condition in an opposite non-engaged staple end of said staple central length portion; and F. applying subsequently a continued pulling force to complete said release of said engaged staple end and a continued directional rotational traverse of said opposite non-engaged staple end; whereby a similar dimension of said opposite staple end length portions contribute to simultaneous disengagement thereof to obviate inadvertent injury.

* * * * *